US006123479A

United States Patent [19]

Dumke

[11] Patent Number: 6,123,479

[45] Date of Patent: Sep. 26, 2000

[54] HANGING MULTIPLE PAGE PROTECTOR

[76] Inventor: John E. Dumke, 3669 Neuburg Ct., Hubertus, Wis. 53033

[21] Appl. No.: 09/382,928

[22] Filed: Aug. 25, 1999

Related U.S. Application Data

[60] Provisional application No. 60/099,419, Sep. 8, 1998.

[51] Int. Cl.[7] ..... B42F 13/40

[52] U.S. Cl. ..... 402/4; 211/46; 283/36; 283/38; 312/184; 402/80 L

[58] Field of Search ..... 283/36, 37, 38, 283/39, 40, 41; 211/46; 312/184; 402/4, 16, 17, 80 L, 80 P, 80 R

[56] References Cited

U.S. PATENT DOCUMENTS

| | | | |
|---|---|---|---|
| 3,865,445 | 2/1975 | Dean et al. | 402/4 |
| 3,980,360 | 9/1976 | Wright et al. | 402/4 |
| 4,009,784 | 3/1977 | Elias et al. | 402/4 |
| 4,171,854 | 10/1979 | Hedstrom et al. | 402/17 |
| 4,231,174 | 11/1980 | Thompson | 40/10 A |
| 4,445,799 | 5/1984 | Wright et al. | 402/4 |
| 4,516,871 | 5/1985 | Leitman | 283/40 |
| 4,784,508 | 11/1988 | Shannon | 402/79 |
| 5,503,487 | 4/1996 | Ong | 283/37 |
| 6,019,539 | 2/2000 | Lynton | 402/79 |

*Primary Examiner*—A. L. Wellington
*Assistant Examiner*—Monica Carter
*Attorney, Agent, or Firm*—Donald J. Ersler

[57] ABSTRACT

A hanging multiple page protector includes a plurality of page protectors, a hanging base, and a retainer member. The hanging base includes an elongated plate with a plurality of peg projections extending from a front thereof. A magnet strip is preferably attached to a back of the handing base. Preferably, at least two attachment lugs extend from one of the lengthwise edges of the hanging base. Each attachment lug has at least one opening disposed therethrough. Each page protector is fabricated from a clear plastic material. The page protector has at least two openings disposed in a top thereof which are positioned to allow insertion of the plurality of peg projections. The bottom of each page preferably has a tab retainer. The tab retainer has an opening for insertion of a tab element. The retainer member has a peripheral edge disposed on a back thereof that is sized to loosely receive the hanging base. A user may choose the magnet strip for hanging, the two attachment lugs with a nails, or stick pins; or any other suitable attachment method.

22 Claims, 5 Drawing Sheets

HANGING MULTIPLE PAGE PROTECTOR

CROSS-REFERENCE TO RELATED APPLICATIONS

This is a utility application, having priority from provisional patent application, Ser. No. 60/099,419 filed on Sep. 8, 1998.

BACKGROUND OF THE INVENTION

1. Field of the Invention

The present invention relates generally to page protectors and more specifically to a hanging multiple page protector which allows a plurality of pages to be protected and easily accessible at a single location.

2. Discussion of the Prior Art

Conveying information on several pages usually requires individual pages to be displayed side by side. Sometimes a stack of pages will be stapled together and attached to a bulletin board, or the like. The pages will usually become damaged after numerous people touch and pull the pages. If the pages are attached to a refrigerator in a home, the pages may become smeared up by the hands of well meaning, but messy children.

Accordingly, there is a clearly felt need in the art for a hanging multiple page protector which provides protection for a plurality of pages, provides easy attachment to nearly any type of surface, and allows easy replacement of the pages contained therein.

SUMMARY OF THE INVENTION

The primary objective of the present invention is to provide a hanging multiple page protector which provides protection for a plurality of pages, provides easy attachment to nearly any type of surface, and allows easy replacement of the pages contained therein.

According to the present invention, a hanging multiple page protector includes a plurality of page protectors, a hanging base, and a retainer member. The hanging base includes an elongated plate with at least two peg projections extending from a front thereof. A magnet strip is preferably attached to a back of the handing base. Preferably, at least two attachment lugs extend from one of the lengthwise edges of the hanging base. Each attachment lug has at least one opening disposed therethrough. Each page protector is fabricated from a clear plastic material. The page protector has at least two openings disposed in a top thereof which are positioned to allow insertion of at least two peg projections. The bottom of each page preferably has a tab retainer. The tab retainer has an opening for insertion of a tab element. The retainer member has a peripheral wall disposed on a back thereof that is sized to loosely receive the hanging base. At least two shallow bores are formed in the back to provide clearance for the at least two peg projections. The hanging multiple page protector may be assembled in the following manner. The plurality of page protectors are assembled such that the tab retainers are in proper order. The top of the plurality of page protectors are placed over the at least two peg projections. The retainer member is then snapped over the hanging base. At least one page is then inserted into each page protector. The hanging multiple page protector may be hung with hook and loop fasteners; double sided tape; a strip magnet by attaching thereof to a ferrous metal surface, inserting stick pins or nails through the openings; or with any other suitable attachment method.

Accordingly, it is an object of the present invention to provide a hanging multiple page protector which provides protection for a plurality of pages.

It is a further object of the present invention to provide a hanging multiple page protector which provides easy attachment to any type of surface.

Finally, it is another object of the present invention to provide a hanging multiple page protector which allows easy replacement of the pages contained therein.

These and additional objects, advantages, features and benefits of the present invention will become apparent from the following specification.

DETAILED DESCRIPTION OF THE PREFERRED EMBODIMENTS

Figure 1:
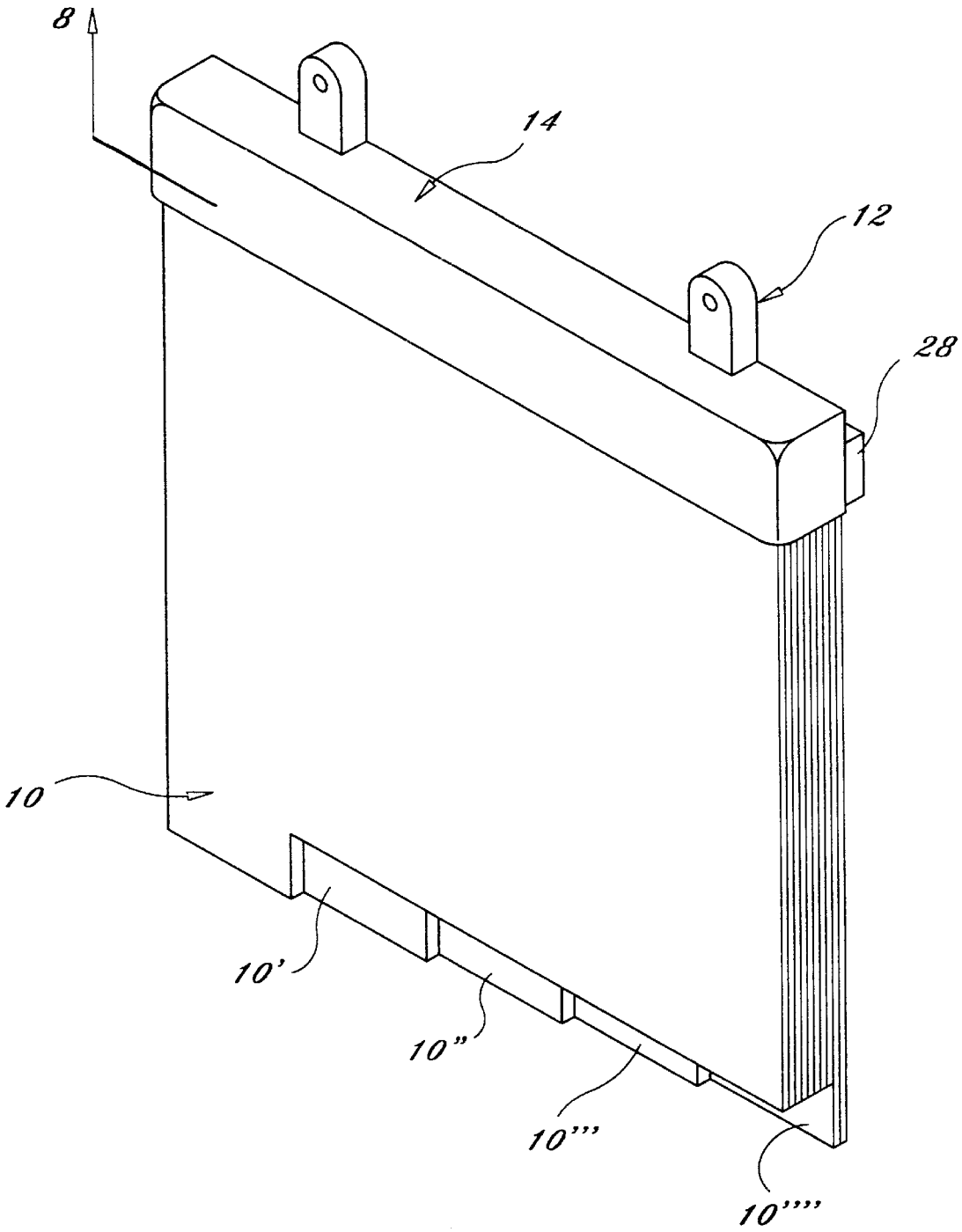
FIG. 1 is a perspective view of an assembled hanging multiple page protector in accordance with the present invention.
Figure 8:
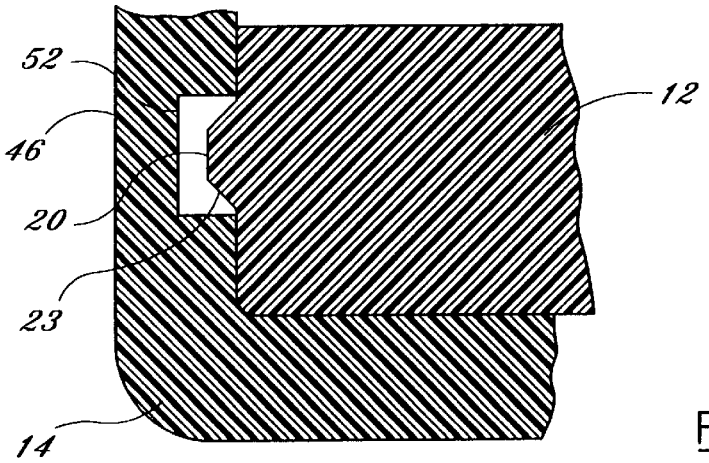
FIG. 8 is an enlarged cross-sectional view of a clip-in projection of a hanging base snapped into a clip-in notch of a retainer member in accordance with the present invention.
Figure 9:
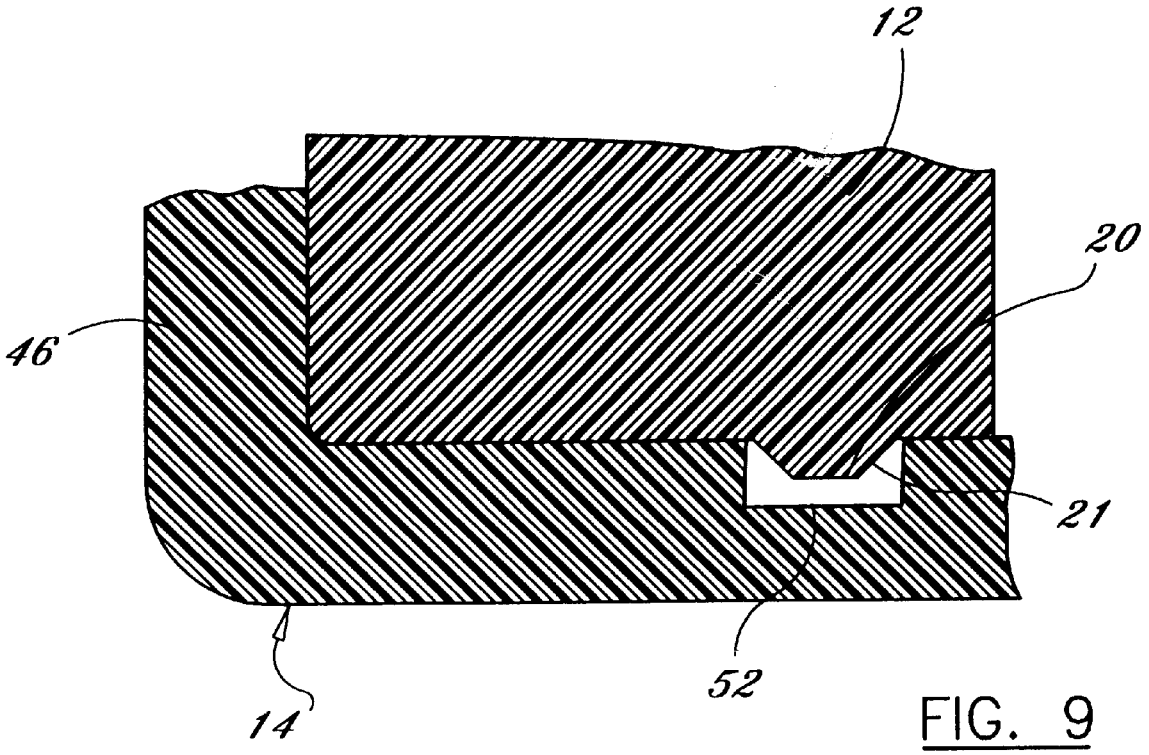
FIG. 9 is an enlarged rear sectional-view of a clip-in projection of a hanging base snapped into a clip-in notch of a retainer member in accordance with the present invention.

With reference now to the drawings, and particularly to FIG. 1, there is shown a perspective view of a hanging multiple page protector 1. With reference to FIGS. 2, and 4–7, a hanging multiple page protector 1 includes a plurality of page protectors 10, a hanging base 12, and a retainer member 14. The hanging base 12 includes an elongated plate 16 with at least two peg projections 18 extending from a front thereof. The hanging base 12 also includes a plurality of clip-in projections 20. With reference to FIGS. 8 and 9, each clip-in projection 20 preferably has a lengthwise chamfered edge 21 and a widthwise chamfered edge 23. The clip-in projections 20 should not be limited to being shaped with the lengthwise chamfered edge 21 and the widthwise chamfered edge 23, but may include a curved or radiused shape, or any other shape that is appropriate. The plurality of clip-in projections 20 are disposed around a peripheral edge of the hanging base 12. Preferably, at least two attachment lugs 22 extend from a lengthwise edge of the hanging base 12. An opening 26 is formed through each attachment lug 22. The opening 26 is preferably round in shape, but could be any shape which allows nails, stick pins, or the like to be inserted therethrough. A single hiding lug 24 extends from said hanging base 12 opposite each attachment lug 22. A magnet strip 28 is preferably attached to a back of the hanging base 12. A user may choose the magnet strip 28; the two attachment lugs 22 with nails or stick pins; or any other suitable method for suspending the hanging multiple page protector.

Figure 2:
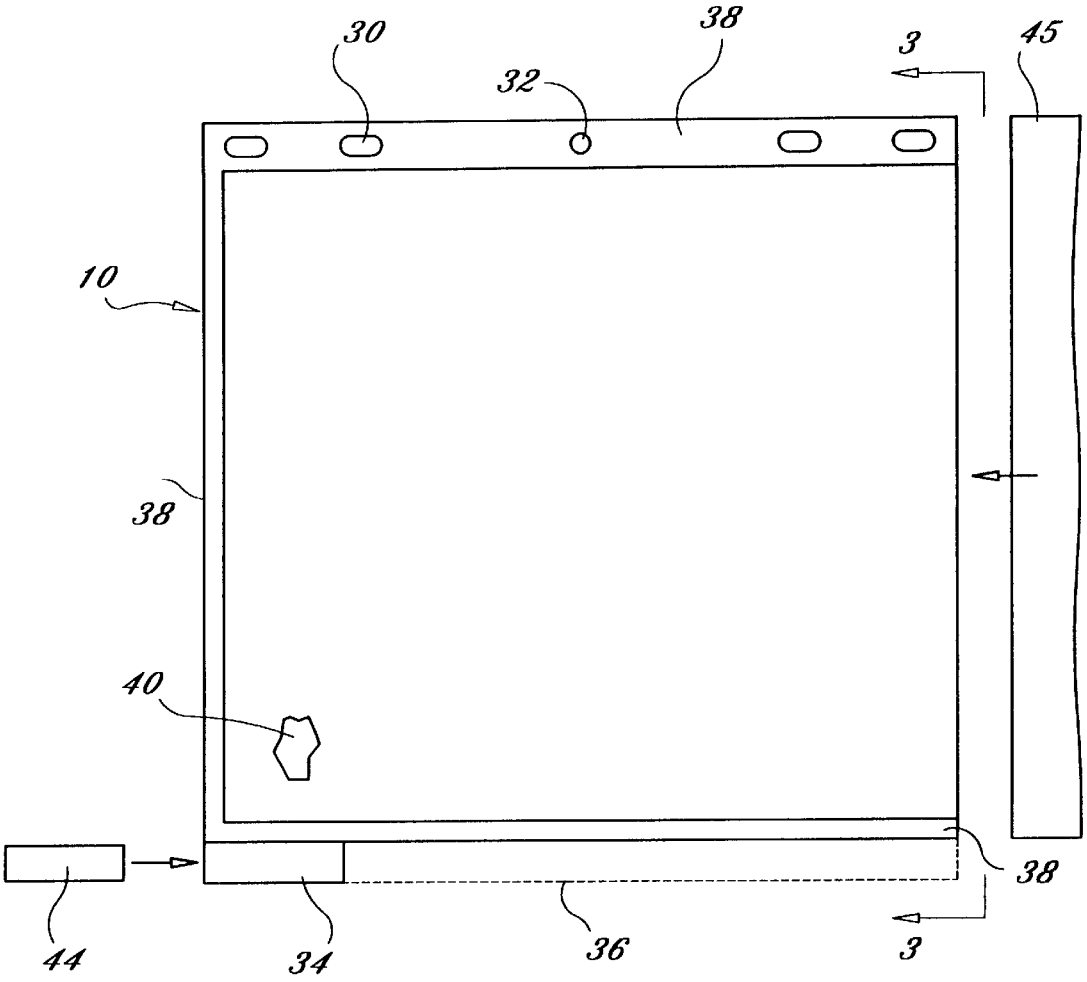
FIG. 2 is a front view of a single page protector in accordance with the present invention.
Figure 3:
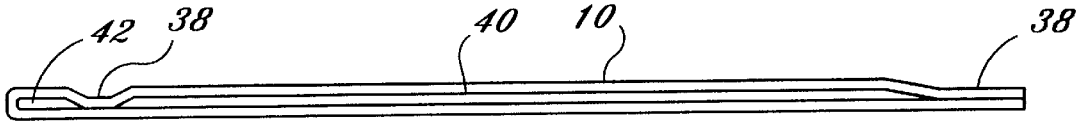
FIG. 3 is an end view of a page protector in accordance with the present invention.
Figure 4:
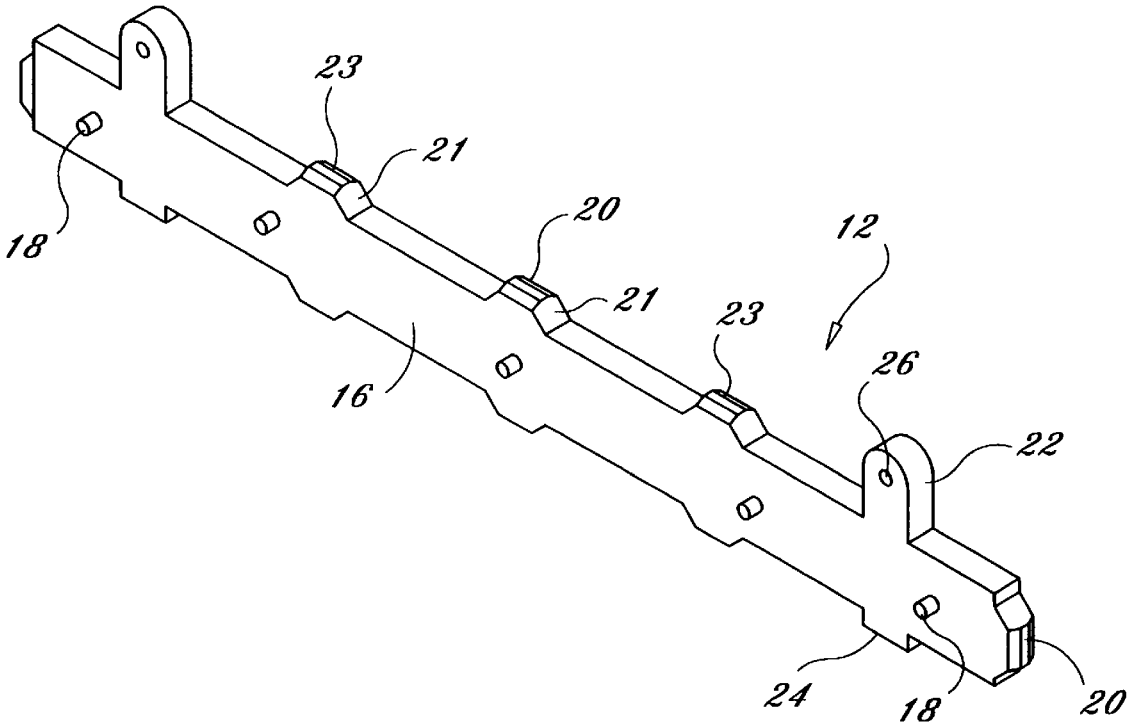
FIG. 4 is a perspective view of a hanging base in accordance with the present invention.
Figure 5:
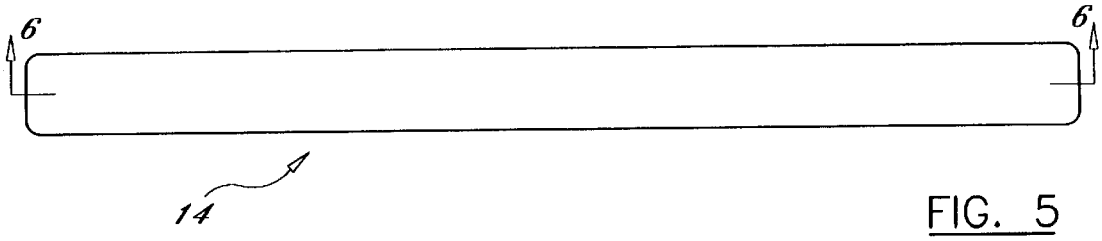
FIG. 5 is a front view of a retainer member in accordance with the present invention.
Figure 6:
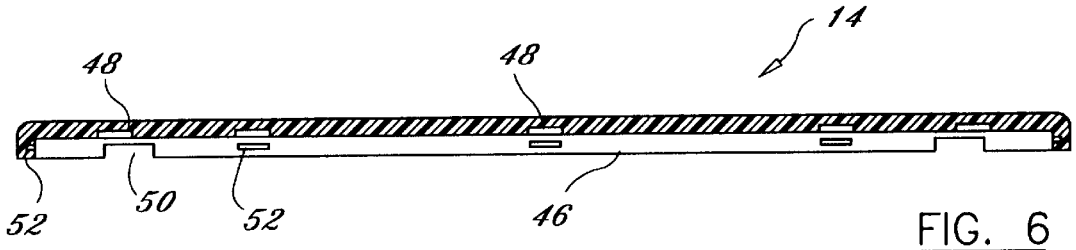
FIG. 6 is a cross-sectional view of a retainer member in accordance with the present invention.
Figure 7:
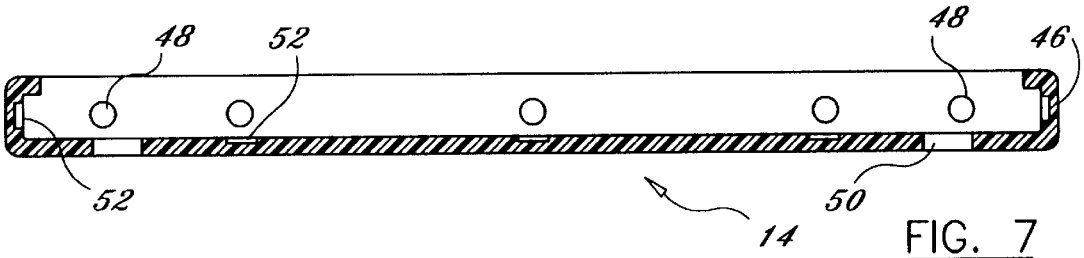
FIG. 7 is a rear cross-sectional view of a retainer member in accordance with the present invention.
Figure 10:
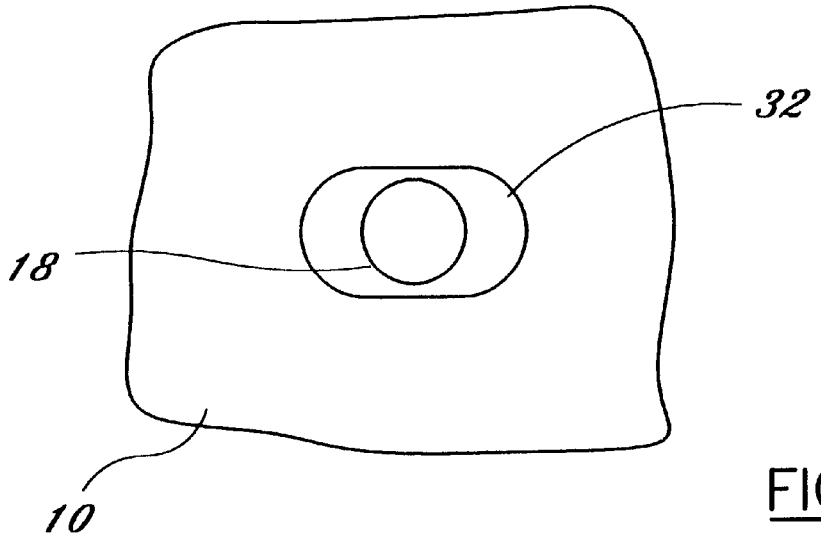
FIG. 10 is an enlarged view of a projection peg inserted into a side opening in accordance with the present invention.

With reference to FIGS. 2 and 3, each page protector 10 is preferably fabricated from a clear plastic material. The page protector 10 preferably has at least one side opening 30 and a center opening 32 disposed in a top thereof. The at least two openings are positioned to facilitate efficient insertion of the at least two peg projections 18. The center opening 32 is preferably round in shape and the at least one side opening 30 is preferably oval in shape. The oval shape is centered about the peg projection 18 location. With reference to FIG. 10, each side opening 30 preferably has a width which is at least 0.03 inches greater than the width of each projection peg 18 and a height which is preferably at least 0.003 inches greater than the height of the projection peg 18. The oval shape of the at least one side opening 30 provides more efficient assembly of the plurality of page protectors 10 to the hanging base 12. The bottom of each page preferably has a tab retainer 34. The tab retainer 34 has a tab opening 42 for insertion of a tab element 44.

A page of paper 45 is inserted into page opening 40. Preferably, the page protectors 10–10"" each have the tab retainers 34 in a different positions, similar to file folders. The page protector 10 is preferably fabricated from a single sheet of clear plastic material which is folded over at a bottom thereof. A cutout portion 36 is removed from the bottom to form the tab retainer 34. The position of the tab retainer 34 and cutout portion 36 will be different for each page protector 10. The page protector 10 is preferably sealed on three sides. Where no sealed areas 38 occur, the page opening 40 and the tab opening 42 are formed in the page protector 10. The page opening 40 allows insertion of at least one page of paper.

The retainer member 14 has a peripheral wall 46 disposed on a back thereof that is sized to loosely receive the hanging base 12. At least two shallow bores 48 are formed in the back of the retainer member 14 to provide clearance for the at least two peg projections 18. Two lug clearance notches 50 are formed in the peripheral wall 46. The two lug clearance notches 50 are positioned to loosely receive the two attachment lugs 22 or the two hiding lugs 24. A plurality of clip-in notches 52 are formed in the peripheral wall 46. The plurality of clip-in notches 52 are sized to allow the plurality of clip-in projections 20 to be snapped therein. FIG. 8 shows an enlarged cross-sectional view of the clip-in projection 20 snapped into the clip-in notch 52. FIG. 9 shows an enlarged rear cross-sectional view of the clip-in projection 20 snapped into the clip-in notch 52.

The hanging multiple page protector 1 may be assembled in the following manner. The plurality of page protectors 10–10"" are assembled such that the tab retainers 34 are in proper order. The at least two openings in the top of the plurality of page protectors 10–10"" are placed over the at least two peg projections 18. The retainer member 14 is then snapped over the hanging base 12. At least one page of paper is inserted into each page protector 10. The hanging multiple page protector 1 may be hung with hook and loop fasteners; double sided tape; a strip magnet by attaching thereof to a ferrous metal surface, inserting stick pins or nails through the openings 26 and into a bulletin board; or with any other suitable attachment method.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A hanging page protector comprising:

at least one page protector, each said page protector having at least two openings in a top thereof;

a hanging base having at least two projection pegs extending therefrom, each said projection pegs being disposed to align with said at least two openings in each said page protector;

a retainer member being attachable to said hanging base, said retainer member preventing said at least one page protector from being removed from said at least two projection pegs; and a plurality of clip-in projections being formed around a peripheral edge of said hanging base.

2. The hanging page protector of claim 1, further comprising:

a pair of attachment lugs extending from said hanging base, each said attachment lug having an opening formed therethrough.

3. The hanging page protector of claim 1, further comprising:

a peripheral wall being formed on a rear of said retainer member, an inside of said peripheral wall being sized to receive said hanging base.

4. The hanging page protector of claim 3, wherein:

a plurality of clip-in notches being formed inside said peripheral wall, said plurality of clip-in notches being disposed such that they align with said plurality of clip-in projections, said hanging base being capable of snapping into said retainer member.

5. The hanging page protector of claim 1, further comprising:

a tab retainer being disposed on a bottom of each said page protector, said tab retainer having an opening which is sized to receive a tab element, said tab retainer being disposed in a different location when at least three page protectors are used.

6. The hanging page protector of claim 2, further comprising:

a single hiding lug extending from said hanging base opposite each said attachment lug.

7. The hanging page protector of claim 6, further comprising:

a peripheral wall being formed on a rear of said retainer member, a lug notch being formed in said peripheral wall, said lug notch being disposed in said peripheral wall to provide clearance for said attachment lug or said single hiding lug.

8. The hanging page protector of claim 1, further comprising:

a strip magnet being attached to a rear of said hanging base.

9. The hanging page protector of claim 1, further comprising:

a center opening being formed in a top of each said page protector, said center opening being formed in a center of said top, at least one side opening being formed in substantially each end of said top, each said side opening having a width which is greater than the width of each said projection peg.

10. A hanging page protector comprising:

at least one page protector, each said page protector having at least two openings in a top thereof;

a hanging base having at least two projection pegs extending therefrom, each said projection pegs being disposed to align with said at least two openings in each said page protector, a pair of attachment lugs extending from said hanging base, each attachment lug having an opening formed therethrough, a single hiding lug extending from said hanging base opposite each said attachment lug; and a retainer member being attachable to said hanging base, said retainer member preventing said at least one page protector from being removed from said at least two projection pegs.

11. The hanging page protector of claim 10, further comprising:

a plurality of clip-in projections being formed around a peripheral edge of said hanging base.

12. The hanging page protector of claim 10, further comprising:

a peripheral wall being formed on a rear of said retainer member, an inside of said peripheral wall being sized to receive said hanging base.

13. The hanging page protector of claim 12, wherein:

a plurality of clip-in notches being formed inside said peripheral wall, said plurality of clip-in notches being disposed such that they align with said plurality of clip-in projections, said hanging base being capable of snapping into said retainer member.

14. The hanging page protector of claim 10, further comprising:

a tab retainer being disposed on a bottom of each said page protector, said tab retainer having an opening which is sized to receive a tab element, said tab retainer being disposed in a different location when at least three page protectors are used.

15. The hanging page protector of claim 10, further comprising:

a peripheral wall being formed on a rear of said retainer member, a lug notch being formed in said peripheral wall, said lug notch being disposed in said peripheral wall to provide clearance for said attachment lug or said single hiding lug.

16. The hanging page protector of claim 10, further comprising:

a strip magnet being attached to a rear of said hanging base.

17. The hanging page protector of claim 10, further comprising:

a center opening being formed in a top of each said page protector, said center opening being formed in a center of said top, at least one side opening being formed in substantially each end of said top, each said side opening having a width which is greater than the width of each said projection peg.

18. A hanging page protector comprising:

at least one page protector, each said page protector having at least two openings in a top thereof;

a hanging base having at least two projection pegs extending therefrom, each said projection pegs being disposed to align with said at least two openings in each said page protector;

a retainer member being attachable to said hanging base, a peripheral wall being formed on a rear of said retainer member, an inside of said peripheral wall being sized to receive said hanging base, a plurality of clip-in notches being formed inside said peripheral wall, said plurality of clip-in notches being disposed such that they align with said plurality of clip-in projections, said hanging base being capable of snapping into said retainer member, said retainer member preventing said at least one page protector from being removed from said at least two projection pegs; and a plurality of clip-in projections being formed around a peripheral edge of said hanging base.

19. The hanging page protector of claim 18, further comprising:

a pair of attachment lugs extending from said hanging base, each said attachment lug having an opening formed therethrough.

20. The hanging page protector of claim 18, further comprising:

a tab retainer being disposed on a bottom of each said page protector, said tab retainer having an opening which is sized to receive a tab element, said tab retainer being disposed in a different location when at least three page protectors are used.

21. The hanging page protector of claim 18, further comprising:

a strip magnet being attached to a rear of said hanging base.

22. The hanging page protector of claim 18, further comprising:

a center opening being formed in a top of each said page protector, said center opening being formed in a center of said top, at least one side opening being formed in substantially each end of said top, each said side opening having a width which is greater than the width of each said projection peg.

* * * * *